US007261131B2

(12) United States Patent
Cleveland et al.

(10) Patent No.: US 7,261,131 B2
(45) Date of Patent: Aug. 28, 2007

(54) ARTICULATED NOZZLE CLOSURE FOR FLUID DISPENSERS

(75) Inventors: James R. Cleveland, Carpentersville, IL (US); Tim Hogan, Round Lake Beach, IL (US)

(73) Assignee: Fluid Management, Inc., Wheeling, IL (US)

( * ) Notice: Subject to any disclaimer, the term of this patent is extended or adjusted under 35 U.S.C. 154(b) by 532 days.

(21) Appl. No.: 10/801,615

(22) Filed: Mar. 16, 2004

(65) Prior Publication Data

US 2005/0205154 A1 Sep. 22, 2005

(51) Int. Cl.
*B65B 1/30* (2006.01)
*B67D 3/00* (2006.01)

(52) U.S. Cl. ..... 141/192; 141/255; 141/311 A; 222/504; 222/560

(58) Field of Classification Search ..... 141/86, 141/87, 90, 192, 255, 311 A; 222/111, 148, 222/333, 504, 505, 516, 560
See application file for complete search history.

(56) References Cited

U.S. PATENT DOCUMENTS 2,785,707 A 3/1957 Ryan, Jr. et al.
3,918,616 A 11/1975 Goldsmith et al.
5,083,591 A 1/1992 Edwards et al.
5,328,057 A 7/1994 Hellenberg et al.
5,390,714 A 2/1995 North, III et al.
5,542,572 A 8/1996 Davis
5,562,129 A * 10/1996 Graffin ..... 141/90
5,622,692 A 4/1997 Rigg et al.
5,632,314 A 5/1997 Koppe et al.
5,690,252 A 11/1997 Oleksiewicz et al.
5,697,527 A 12/1997 Altieri, Jr. et al.
5,711,458 A 1/1998 Langeveld et al.
5,785,960 A 7/1998 Rigg et al.

(Continued)

FOREIGN PATENT DOCUMENTS

DE 9409331 8/1994

(Continued)

OTHER PUBLICATIONS

International Search Report, PCT/US2005/008406, European Patent Office as international searching authority.

*Primary Examiner*—Timothy L. Maust
(74) *Attorney, Agent, or Firm*—Miller, Matthias & Hull

(57) ABSTRACT

A closure system for a fluid outlet is disclosed which includes a motor threadably connected to a hub which, in turn, is connected to a closure element or cup that provides a sealing cover beneath one or more nozzles. The action of the motor initially lowers the closure element vertically before pivoting the closure element away from the area directly beneath the nozzle or nozzles. After fluid is dispensed, a biasing element pivots the closure element back into place before it is raised vertically again to provide a seal or cover for the one or more nozzles. The hub is designed to pivot only a partial revolution and the pivoting action of the hub and closure element away from the nozzle area overcomes the bias of the biasing element contained within the hub. The biasing element then pivots the hub and closure element back into place before the biasing element raises the hub and closure element to its original position.

20 Claims, 7 Drawing Sheets

U.S. PATENT DOCUMENTS

| | | | | |
|---|---|---|---|---|
| D401,246 | S | 11/1998 | Langeveld et al. | |
| 5,842,641 | A | 12/1998 | Mazzalveri | |
| 5,903,465 | A | 5/1999 | Brown | |
| 5,945,112 | A | 8/1999 | Flynn et al. | |
| 5,992,691 | A | 11/1999 | Post et al. | |
| 6,003,731 | A | 12/1999 | Post et al. | |
| 6,024,250 | A | 2/2000 | Hickey | |
| 6,089,538 | A | 7/2000 | Shirkhan | |
| 6,221,145 | B1 | 4/2001 | McClain | |
| 6,267,157 | B1 * | 7/2001 | Gruson et al. | 141/90 |
| 6,273,298 | B1 | 8/2001 | Post et al. | |
| 6,398,513 | B1 | 6/2002 | Amsler et al. | |
| 6,412,658 | B1 | 7/2002 | Bartholomew et al. | |
| D461,080 | S | 8/2002 | Bartholomew et al. | |
| D465,810 | S | 11/2002 | Bartholomew et al. | |
| 6,510,366 | B1 | 1/2003 | Murray et al. | |
| D472,253 | S | 3/2003 | Reedy et al. | |
| 6,540,486 | B2 | 4/2003 | Amsler et al. | |
| 6,615,881 | B2 | 9/2003 | Bartholomew et al. | |
| 6,622,064 | B2 | 9/2003 | Bartholomew et al. | |
| D485,310 | S | 1/2004 | Bartholomew et al. | |
| 6,672,341 | B2 | 1/2004 | Bartholomew et al. | |
| 2001/0047309 | A1 | 11/2001 | Bartholomew et al. | |
| 2002/0010528 | A1 | 1/2002 | Bartholomew et al. | |
| 2003/0060925 | A1 | 3/2003 | Bartholomew et al. | |
| 2003/0062379 | A1 | 4/2003 | Bartholomew et al. | |
| 2003/0090176 | A1 | 5/2003 | Bartholomew et al. | |
| 2003/0230355 | A1 | 12/2003 | Bartholomew et al. | |
| 2004/0103954 | A1 | 6/2004 | McGehee | |

FOREIGN PATENT DOCUMENTS

| | | | |
|---|---|---|---|
| EP | 0283137 | A1 | 9/1988 |
| EP | 0947699 | A1 | 10/1999 |
| EP | 0992450 | A1 | 4/2000 |
| EP | 1090679 | A1 | 4/2001 |
| EP | 08-00858 | B1 | 7/2002 |
| EP | 1134186 | B1 | 5/2003 |
| EP | 1352874 | | 10/2003 |
| WO | WO-01-75586 | A1 | 10/2001 |
| WO | WO-03-026458 | A2 | 4/2003 |
| WO | WO-03/031161 | A1 | 4/2003 |
| WO | WO-03/031280 | A1 | 4/2003 |
| WO | WO-03/083334 | A1 | 10/2003 |

* cited by examiner

ARTICULATED NOZZLE CLOSURE FOR FLUID DISPENSERS

TECHNICAL FIELD

An improved closure system for fluid dispensers is shown and described. The disclosed closure system is a motorized, articulated system that, in a closed position, provides a cover or closure for a nozzle or nozzle manifold through which one or more fluids are dispensed. In the closed position, the closure element is disposed beneath the nozzle or nozzle manifold and collects any fluid drippings between dispensing operations and also preferably provides a sealing effect. To move the closure system to an open or to a dispense position, a motor is activated which moves the closure element downward before pivoting the closure element away from the nozzle or nozzle manifold. After the fluid is dispensed, a biasing element pivots the closure element back in place with little risk of injury to the operator. An underside of the closure element or the support structure for the system may also include one or more light emitting devices to help the operator put the container in the proper position to receive fluid before the dispensing operation is commenced. The system may also include a protective cover for safety and cleanliness.

BACKGROUND

Systems for dispensing a plurality of different fluids into a container have been known and used for many years. For example, systems for dispensing paint base materials and colorants into a paint container are known. These paint systems may use twenty or more different colorants to formulate a paint mixture. Each colorant is contained in a separate canister or package and may include its own dispensing pump. The colorants and the respective pumps may be disposed on a turntable or along one or more horizontal rows. In a turntable system, the turntable is rotated so that the colorant of to be dispensed is moved to a position above the container being filled. In designs using one or more horizontal rows, the container may be moved laterally to the appropriate colorant/pump.

Systems for dispensing large varieties of different fluids are not limited to paints, but also include systems for dispensing pharmaceutical products, hair dye formulas, cosmetics or all kinds, nail polish, etc. Smaller systems for use in preparing products at a point of sale may use a stationary manifold through which a plurality of nozzles extend. Each fluid to be dispensed is then pumped through its individual nozzle. Depending upon the size of the container and the quantity of the fluids to be dispensed, manifolds can be designed in a space efficient manner so that a single manifold can accommodate twenty or more different nozzles. The nozzles are connected to the various ingredients by flexible hoses and the ingredients are contained in stationary canisters or containers.

In many fluid dispensing applications, precision is essential as many formulations require the addition of precise amounts of these ingredients. This is true in the pharmaceutical industry but also in the paint and cosmetic industries as the addition of more or less tints or colorants can result in a visible change in the color of the resulting product.

One way in which the precision of dispensing systems is compromised is "dripping." Specifically, a "leftover" drip may be hanging from a nozzle that was intended to be added to a previous formulation and, with a new container in place under the nozzle, the drop of liquid intended for a previous formulation may be erroneously added to a new formulation. Thus, the previous container may not receive the desired amount of the liquid ingredient and the next container may receive too much.

To solve the drip problem, various scraper and wiper designs have been proposed. However, these designs often require one or more different motors to operate the wiper element and are limited to use on dispensing systems where the nozzles are separated or not bundled together in a manifold. Use of a wiper or scraping function would not be practical in a multiple nozzle manifold design as the ingredients from the different nozzles will be co-mingled by the wiper or scraper which would then also contribute to the lack of precision of subsequently produced formulations.

Another problem associated with dispensing systems that make use of nozzles lies in the dispensing of relatively viscous liquids such as tints, colorants, base materials for cosmetic products, certain pharmaceutical ingredients or other fluid materials having relatively high viscosities. Specifically, the viscous fluids have a tendency to dry and cake onto the end of the nozzles, thereby requiring frequent cleaning in order for the nozzles to operate effectively. While some mechanical wiping or scrapping devices are available, these devices are not practical for multiple nozzle manifold systems and the scraper or wiper element must be manually cleaned anyway.

One solution would be to find a way to provide an enclosing seal around the nozzle or manifold after the dispensing operation is complete. In this manner, the viscous materials being dispensed through the nozzles would have less exposure to air thereby requiring a lower frequency of cleaning operations. To date, applicants are not aware of any attempts to provide any sort of nozzle or manifold closure or sealing element that would protect against drips as well as reducing the frequency in which the nozzle or manifolds must be cleaned.

SUMMARY OF THE DISCLOSURE

In satisfaction of the aforenoted needs, an improved closure system for one or more fluid outlets is disclosed. In an embodiment, the system includes a motor connected to a threaded shaft. The threaded shaft is coupled to a hub. The hub is connected to a closure, preferably in the form of a cup, that engages the underside of the nozzle block or manifold for purposes of providing a sealing drip collector beneath the nozzle(s) between uses. When the motor rotates the threaded shaft, the hub, which is enmeshed with the threads on the shaft, moves downward thereby causing the cup to disengage and also move downward away from the nozzle outlet(s). After a predetermined number of rotations of the threaded shaft, a finger or stud connected to an end of the shaft engages an abutment or other structure connected to or that forms a part of the hub. This results in rotation of the hub and the closure away from the nozzle or nozzles thereby allowing fluid to drip from the nozzle to a container disposed there below.

In a refinement, the hub includes a curved slot that accommodates a stationary pin. This curved slot is concentric with an axis defined by the threaded and the threaded hole of the hub through which the shaft passes, but is disposed radially outward from this common axis. When the finger or stud connected to the threaded shaft engages the abutment of the hub, the hub is allowed to partially rotate thereby moving the hub from a position where the stationary pin is disposed at one end of the curved slot to a position where the stationary pin is disposed at the other end of the curved slot.

In another refinement, a biasing mechanism is also included which biases the hub and closure to a position where the closure is disposed beneath the nozzle or manifold. Rotation of the threaded shaft which initially results in downward movement of the hub and closure also works against the bias of the biasing mechanism when the finger or stud engages the abutment, the hub is rotated against the bias of the biasing element to pivot the closure away from the nozzle or manifold. After the fluid is dispensed, the biasing element moves the hub and closure back to a position where the closure is disposed immediately below the nozzle or manifold. Then, a reverse action of the motor spins the shaft in an opposite direction thereby returning the hub and closure upward to its closed and sealed position. The use of a biasing element to rotate the closure element back into place reduces the chance of injury to the operator during the initial movement to the closed position.

In a refinement, the curved slot extends about the common axis for a limited range extended from about 30 to about 60° and preferably about 45°. This limits the pivoting movement of the closure away from the nozzle thereby providing for a relatively compact design. Because of the limited pivotal motion of the closure element, an optional cover may be provided on the underside of the system for safety and cleanliness.

The exact range of pivoting motion of the closure away from the nozzle or manifold will depend upon the particular design. Obviously, larger manifolds will require larger closure elements and therefore a greater range of pivoting motion. Single nozzles will require smaller closure elements and will need a shorter pivoting motion.

In another refinement, the abutment which is engaged by the finger or stud connected to the threaded shaft is a pin that is connected to the hub.

In another refinement, the motor is a one-way motor thereby allowing the system to rely upon the biasing mechanism to return the closure from its open and unsealed position back to its closed and sealed position after the dispensing operation is completed.

In another refinement, the biasing member is a spring connected to the threaded shaft. Preferably, the spring is a torsional spring with two radially outwardly extending legs. One leg of the spring is connected to the hub or received within a recess disposed within the hub body. The other leg of the spring engages the stationary pin. Further, the spring preferably includes a body portion that wraps around a distal end of the threaded shaft.

In another refinement, the threaded shaft extends from the motor or a coupling connected to a separate motor shaft through an upper portion of the hub and terminates in a recess disposed within the lower portion of the hub. The biasing element, abutment and a distal end of the stationary pin are all disposed within this recess.

In another refinement, the lower end of the hub is connected to an arm which extends radially outward from the hub and which, in turn, is connected to the closure which seals off or encloses the nozzle, nozzles or manifold, depending upon the particular application.

In another refinement, one or more light emitting devices such as light emitting diodes (LEDs) may be included for assisting the operator to properly place the container below the nozzle or manifold. Preferably, the light emitters are disposed on an underside of the cup or closure or on an underside of the arm connecting the cup or closure to the hub. The light emitters may also be disposed along the outer side of any support structure or on the hub itself. If the light emitters are disposed on the underside of the arm connecting the closure to the hub or on the underside of the hub, the light emitters are pivoted out of the way when the fluid is dispensed, and are therefore protected against splashing or being coated with fluid material which would limit or impede there effectiveness.

In another refinement, the hub is a cylindrical structure with a top end that is generally flat and that faces the motor, as either in direct contact with the motor or engages a mounting plate disposed between the motor and the hub. The underside of the hub includes a recess for accommodating the biasing mechanism, distal end of the threaded shaft and the finger or stud that twists the hub when it engages the abutment. Preferably, the abutment structure which is engaged by the finger or stud during rotation of the threaded shaft is also disposed within this recess and, preferably, is a pin that extends through the body of the hub and proceeds down into the recess where it can be engaged by the finger or stud. This pin may also be a threaded structure such as a screw of threaded shaft to facilitate its connection to the hub.

In another refinement, the distal end of the threaded shaft is connected to a retainer element. The retainer element serves to keep the biasing element (preferably a spring) in place and provides an easy means for attaching the finger or stud which engages the abutment for purposes of rotating the hub and closure element out of the way of a nozzle or manifold.

An improved method for dispensing fluid is also provided. The method comprises providing a fluid outlet; providing a cup-like closure beneath the fluid outlet and for engaging a surface surrounding the fluid outlet for isolating the fluid outlet from the ambient atmosphere during non-use; using a motorized function, moving the closure vertically downward away from the fluid outlet before moving the closure along an arc away from the fluid outlet thereby clearing a path beneath the fluid outlet so that fluid may be dispensed from the outlet to a container disposed therebelow; using a biasing element to return the closure beneath the fluid outlet; and reversing the motor to move the closure vertically upward back into the original sealing position.

BRIEF DESCRIPTION OF THE DRAWINGS

The disclosed embodiments are described more or less diagrammatically in the accompanying drawings, wherein.

While a single embodiment is shown and described, alternative embodiments and variations will be described below and still other variations will be apparent to those skilled in the art.

DETAILED DESCRIPTION OF THE PRESENTLY PREFERRED EMBODIMENTS

Figure 1:
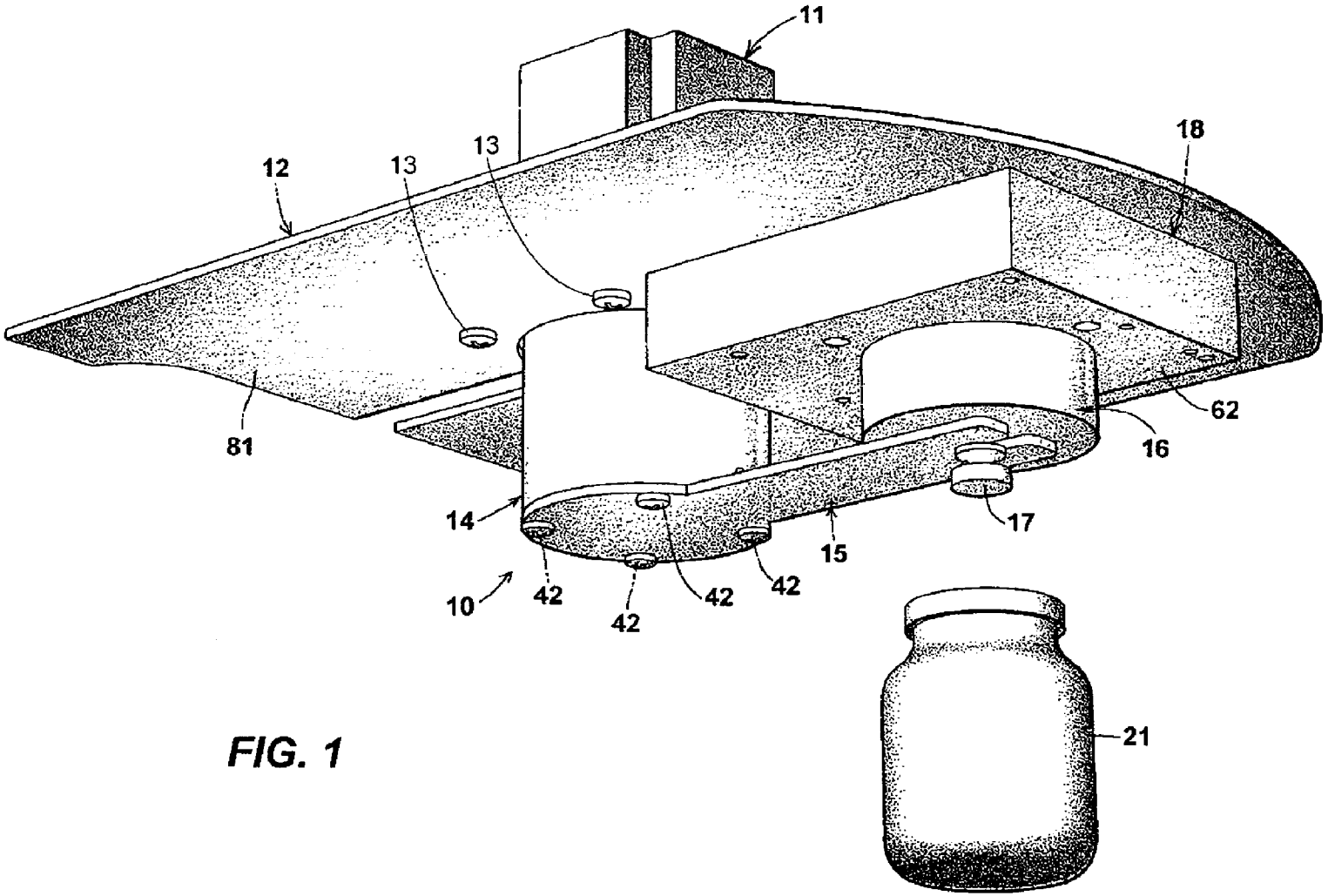
FIG. 1 is a bottom perspective view of an articulated closure system for a fluid dispensing system made in accordance with this disclosure as well as a container for receiving dispensed fluid.

Turning to FIG. 1, a closure system 10 is disclosed which includes a motor 11 supported by a mounting plate 12. The motor 11 is connected to the mounting plate by a plurality of fasteners shown at 13. The motor 11 is coupled to a hub 14 which, in turn, is connected to an arm 15 which connects the hub 14 to a closure element 16 which, in the embodiment shown, is a cup-shaped structure. A fastener 17 is used to connect the arm 15 to the closure element 16. It would be noted that the hub structure 14 could be altered so that it is connected directly to the closure element 16. As shown in the position of FIG. 1, the closure element 16 engages the underside of a block 18 which surrounds one or more nozzles 19 (see FIG. 2). A container 21 is disposed below and in general alignment with the nozzle 19 and block 18.

Figure 2:
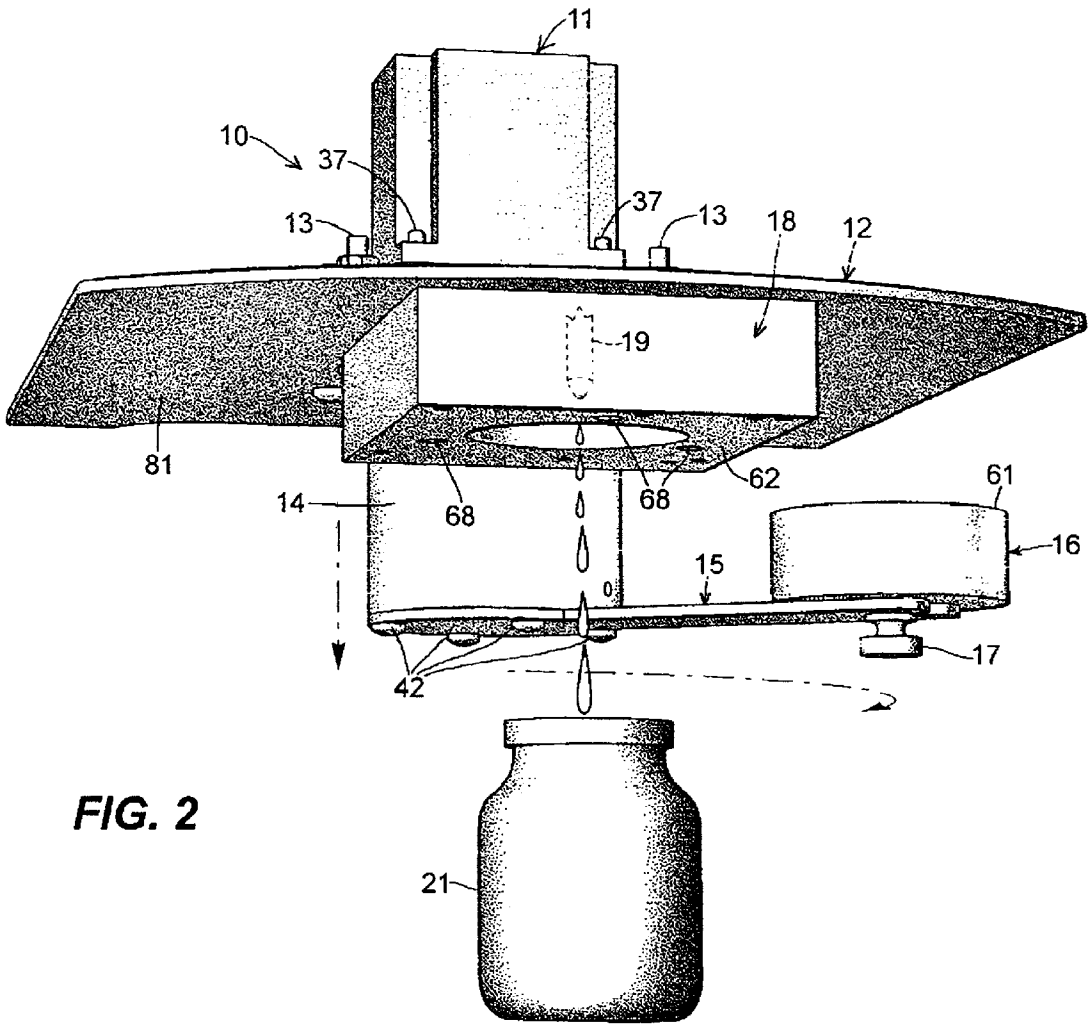
FIG. 2 is an end perspective view of the closure system and container as shown in FIG. 1 with the closure element moved downward and away from a nozzle which is then free to deposit fluid in the shown container.

In the position shown in FIG. 1, the closure system 10 is in a closed or sealed position with the closure element 16 engaging the block 18. Turning to FIG. 2, the system has been moved into an open or dispensed system whereby the hub 14, arm 15 and closure cup 16 have been moved downward and pivoted away thereby clearing a path for fluid to be dispensed from the nozzle 19 to the container 21. The operation of the system 10 to achieve the two positions illustrated in FIGS. 1 and 2 will now be explained with reference to FIGS. 3–8.

Figure 3:
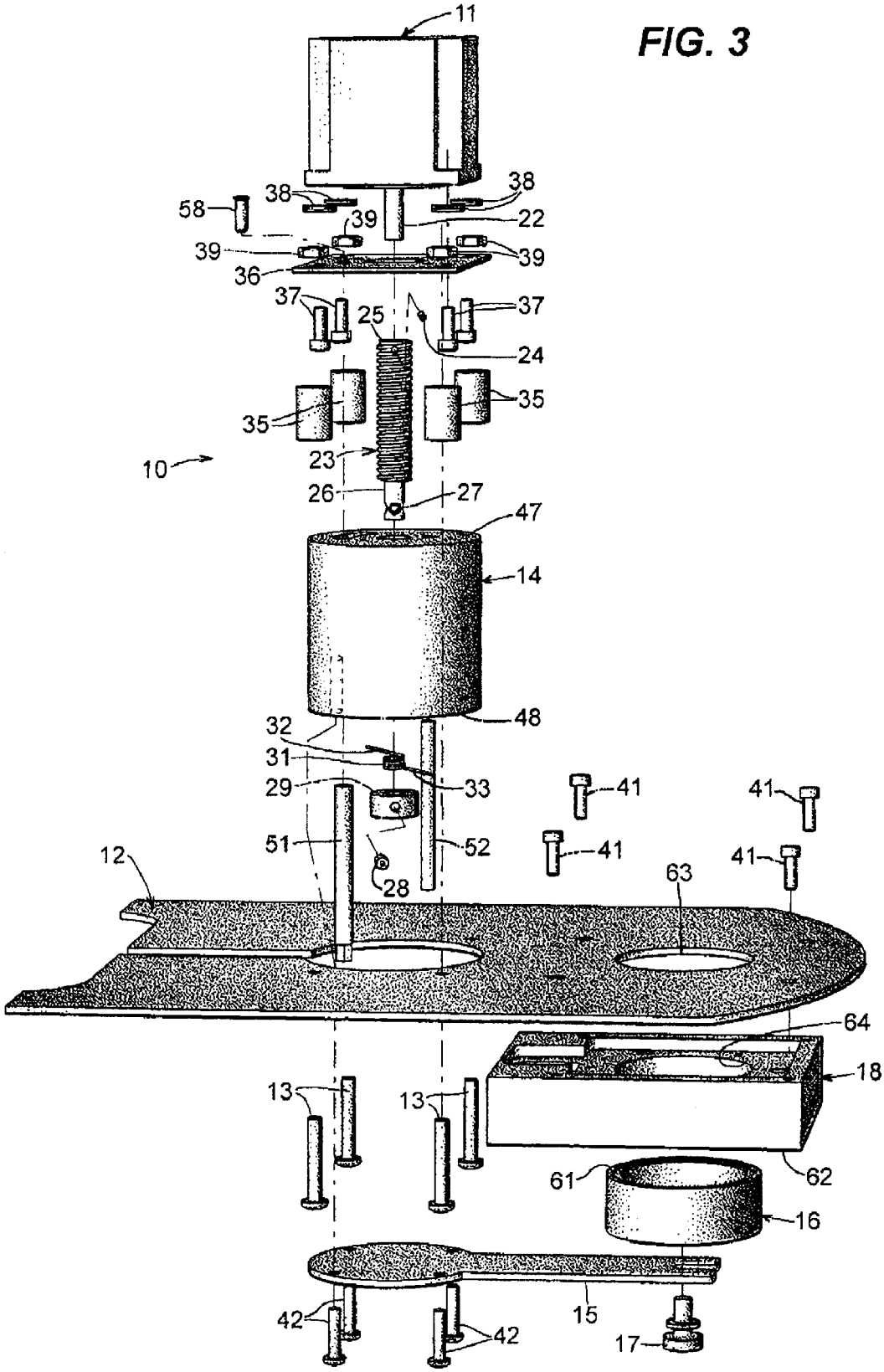
FIG. 3 is an exploded view of the closure system shown in FIGS. 1 and 2.

Turning to FIG. 3, the motor 11 includes the shaft 22. The motor shaft 22 is coupled to a threaded shaft 23 (also referred to as a lead screw) by the set screw 24. Thus, the proximal end 25 of the threaded shaft 23 includes an opening for receiving at least a portion of the motor shaft 22 which is then secured with respect to the threaded shaft 23 by way of the said screw 24. The shafts 22, 23 could also form a unitary structure.

The distal end 26 of the threaded shaft does not include any threads but, instead, includes an opening 27 for receiving the stud or finger shown at 28. The stud or finger 28 can also be used to couple the retainer 29 to the distal end 26 of the threaded shaft 23. The distal end 26 of the threaded shaft 23 also serves as a place for accommodating the biasing element, shown here as the torsional spring 31. The spring 31 includes two legs, including a first leg 32 and second leg 33, the functions of which will be disclosed below.

Spacer elements shown at 35 may also be used to adjust the spacing between the motor 11 in the support plate 12. Fasteners shown 13, 37*a*, washers shown at 38 and nuts shown at 39 are all used to secure the motor 11 to the plate 36. The fasteners shown at 41 are used to secure the block 18 to the plate 12 and the fasteners shown at 42 are used to secure the arm 15 to the hub 14.

Figure 5:
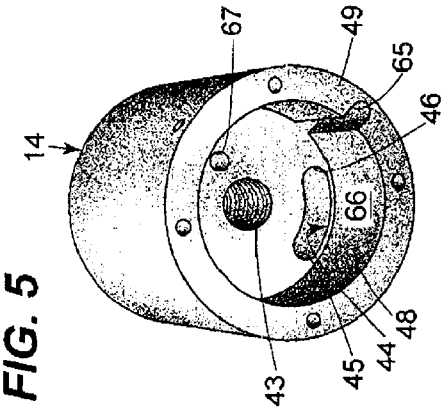
FIG. 5 is a bottom perspective view of the hub shown in FIG. 4.
Figure 4:
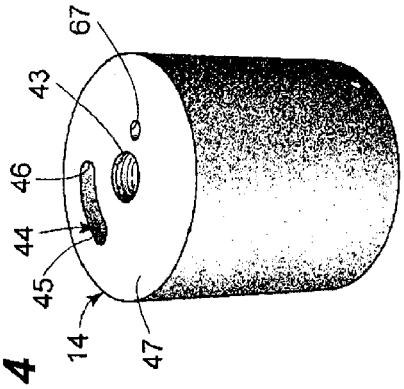
FIG. 4 is a top perspective view of the hub of the closure system shown in FIGS. 1–3.

The hub 14 is not stationary but moves upward and downward vertically upon rotation of the threaded shaft 23 by the motor 11. Specifically, as shown in FIGS. 4 and 5, the block 14 includes a threaded hole 43 having threads that are enmeshed with the threads of the threaded shaft 23. Thus, rotation of the shaft 23 results in upward or downward movement of the hub 14.

Still referring to FIGS. 4 and 5, the hub 14 also includes a curved slot 44 having circumferentially spaced apart ends 45, 46. The curved slot 44 extends through an upward side 47 of the block 14 to a recess 48 that extends upward through the bottom end 49 of the block 14. Returning to FIG. 3, the stationary pin shown at 51 is accommodated in this curved slot 44 and serves to limit any rotational movement of the hub 14 as described below.

Figure 6:
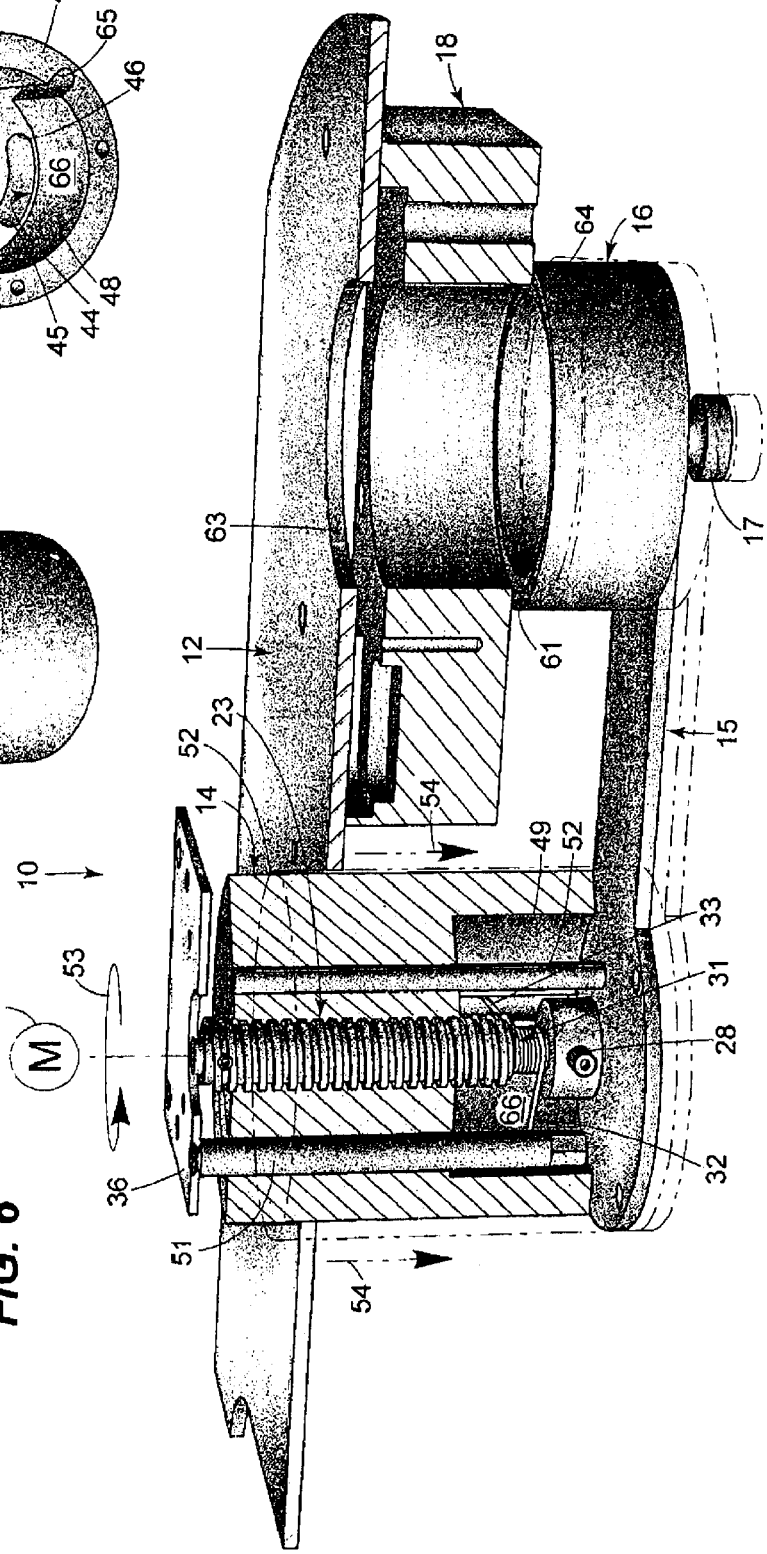
FIG. 6 is a sectional perspective view of the closure system shown in FIGS. 1–3 illustrating an initial downward movement of the hub and closure element away from the nozzle.

The recess 48 accommodates the retainer 29, finger or stud 28 and biasing element 31 as shown in FIG. 6. Returning to FIGS. 3–5, the hub 14 also accommodates an additional pin 52 that serves as an abutment that is engaged by the finger 28 as described below.

Figure 7:
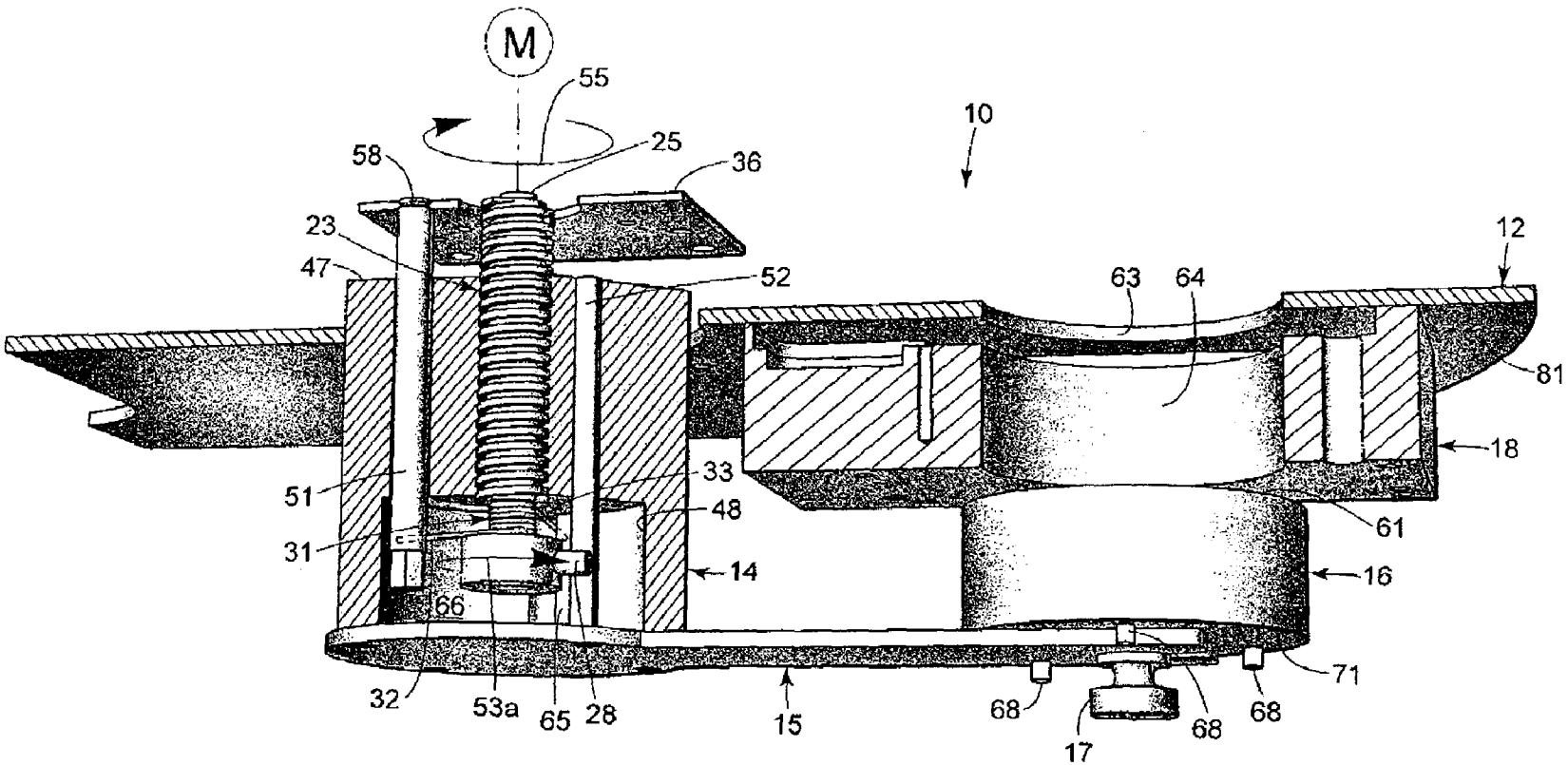
FIG. 7 is a sectional perspective view of the closure system shown in FIG. 6 after it is moved to the vertically downward position as shown in phantom lines in FIG. 6.

Turning to FIG. 6, to move the closure element 16 from the closed position as shown in solid lines, the motor 11 rotates its shaft 22 (see FIG. 3) in the direction of the arrow 53. The threaded shaft 23 is also rotated in this position. Because of the enmeshed relationship between the threaded shaft 23 and the threadable hole 43 of the hub 14, rotation of the threaded shaft 23 in the direction of the arrow 53 causes the hub 14 to move vertically downward in the direction of the arrows 54. As the shaft 23 rotates in the direction of the arrow 53 and the hub 14 moves in the direction of the arrows 54, the finger or stud 28 moves toward the abutment or pin 52. Engagement of the finger 28 with the pin 52 is illustrated in FIG. 7. Continued rotation of the motor 11 and shaft 23 in the direction of the arrow 53*a* (see FIG. 7) causes the finger 28 to push the abutment or pin 52 and the hub 14 in the direction of the arrow 53, 53*a* thereby causing the hub 14, arm 15 and closure cup 16 to pivot in the direction of the arrow 53*a* to the position shown in FIG. 8 against the bias of the spring 31 thereby clearing a path for fluid to exit the nozzle 19 and proceed to the container 21 as shown in FIG. 2.

To return the system 10 to the position shown in FIG. 1, the spring 31 pivots the hub 14 and closure element 16 back to the position shown in FIGS. 6 and 7 and then the motor 11 is reversed to raise the hub 14 and the cup 16 upward to the closed position shown in FIG. 1. The counter rotation of the motor 11 in the direction of the arrow 55 as shown in FIG. 8 causes the threaded shaft 23 to rotate with respect to the hub 14 thereby raising the hub 14 upward after the spring 31 pivots the cup 16 back into place.

Figure 8:
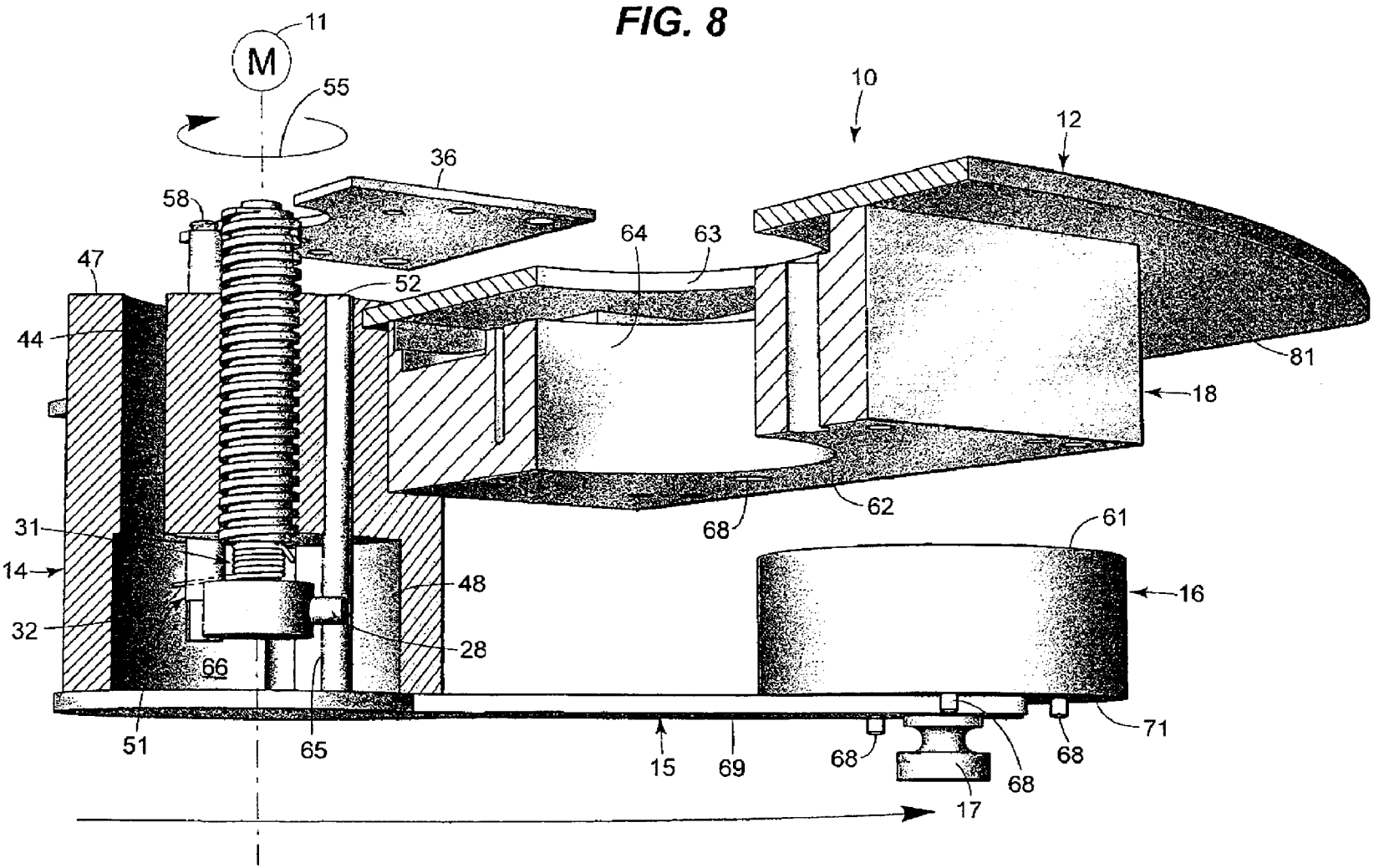
FIG. 8 is a sectional perspective view of the closure system as shown in FIGS. 6 and 7 but after the hub and closure element have pivoted away from the nozzle thereby assuming a dispense position as also shown in FIG. 2 as opposed to the closed position as shown in FIG. 1.

Another design would employ using an abutment pin 52 that does not extend all the way down to the arm 15 as shown in FIGS. 6–8. When moving from the closed position (FIG. 1) to the opened or dispense position (FIGS. 2 and 8), the threaded shaft 23 could be permitted to rotate a number of times before the hub 14 is lowered a sufficient vertical distance so as to enable the finger 28 to engage the shorter abutment pin and then apply the partial rotation of the hub 14 as provided by the curved slot 44 and stationary pin 51. As shown in FIGS. 3 and 6–8, the stationary pin 51 can be secured to the plate 36 by an additional fastener 58.

Preferably, the closure element 16 is in the shape of a cup as shown and is made of a polymeric material so that the upper rim 61 of the cup provides a sealing engagement against the underside 62 of the block 18. Suitable soft plastics, polymers and rubbers will be apparent to those skilled in the art. The specific polymeric material used may depend upon the fluids being dispensed. Specifically, it would be preferable to use a material which would not be harmed by the fluids being dispensed. One consideration would be to use a material for the cup 16 that has a polarity that is different than the fluids being dispensed.

It will also be noted that the hole 63 of the support plate 12 and the opening 64 and the block may provide a fluid path for a single nozzle, multiple nozzles or a manifold block containing multiple nozzles. The number of different fluids passing through the fluid path defined by the openings 63, 64 will depend upon the application for which the system 10 is employed.

As shown in FIGS. 5–8, one leg 32 of the spring 31 engages the stationary pin 51 while the other leg 33 is received within the recess 65 disposed along the inner wall 66 of the main recess 49 of the hub 14. When the finger 28 engages the abutment pin 52 and pushes the hub as shown in FIGS. 7 and 8 in the direction of the arrow 53 (FIG. 6), the motor 11 is overcoming the bias of the spring 31. When the motor is released, the bias of the spring 31 returns the cup 16 from the position shown in FIGS. 2 and 8 to the position shown in FIGS. 1 and 6–7. The hole 67 for receiving abutment pin 52 is shown in FIGS. 4 and 5.

Further as shown in FIGS. 7 and 8, one or more LEDs or other light emitting devices 68 are shown at 68 may be disposed along the underside 71 of the cup 16 to assist the operator in placing the container 21 in the proper location prior to moving the closure system 10 from the closed position as shown in FIG. 1 to the open position as shown in FIG. 2. The underside 69 of the arm 15 may also be used to attach one or more LEDs 68. Also, as shown in FIGS. 1 and 2, the LEDs 68 may be disposed in the underside 72 of the block 18.

By placing the LEDs on the closure element 16 and or arm 15, one avoids the possibility of material being splashed onto the one or more LEDs 68.

Figure 9:
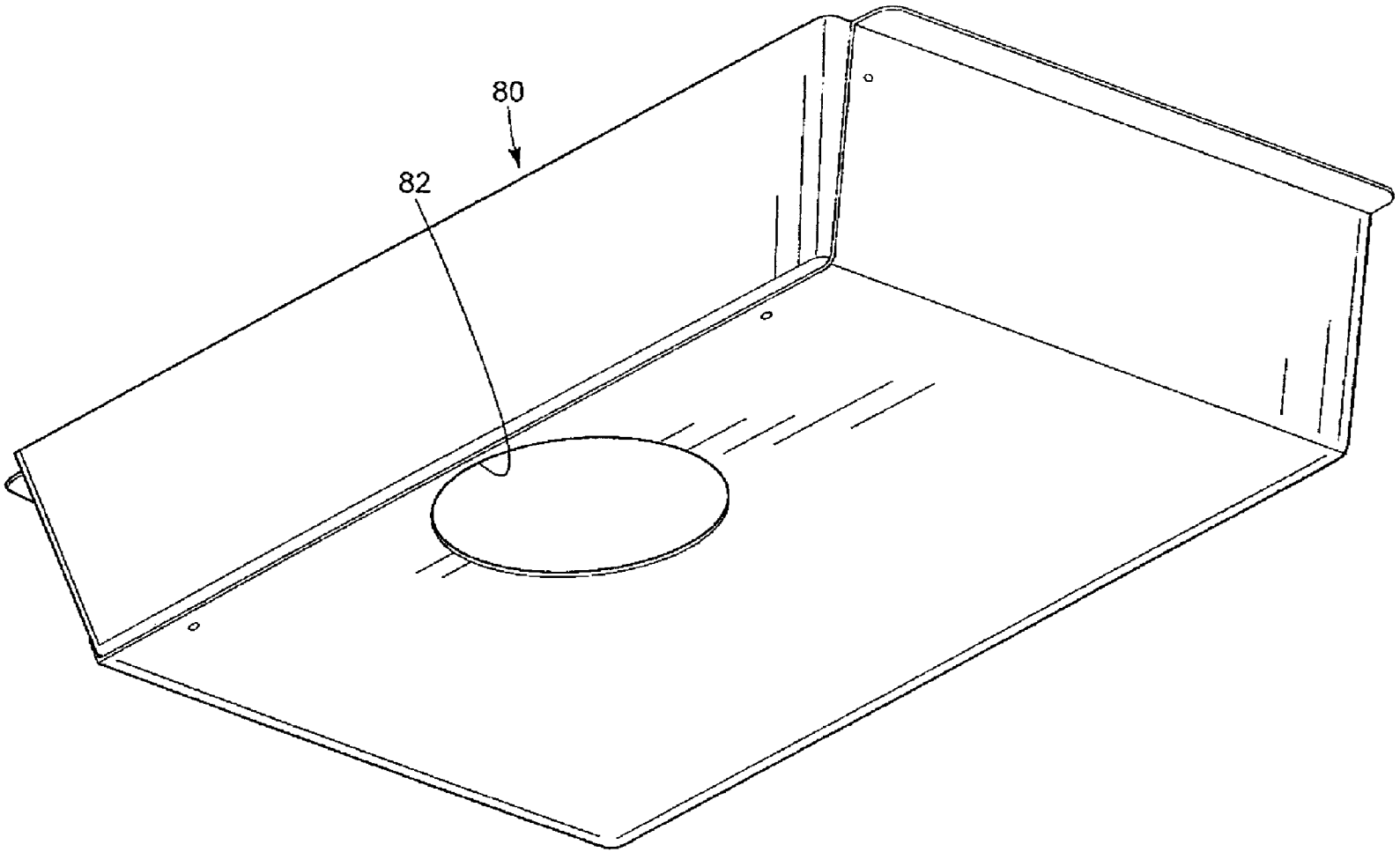
FIG. 9 is a perspective view of a cover for the underside of the system shown in FIGS. 1–8 that provides safety and cleanliness advantages.

FIG. 9 illustrates an enclosure 80 that can be mounted to the underside 81 of the support plate 12. The enclosure 80 includes an opening 82 that is alignment with the opening 64 of the block 18. The enclosure 80 provides enough space for the pivotable movement of the hub 14, arm 15 and cup 16 as described in FIGS. 1–2 and 6–8. An advantage of using an enclosure 80 as shown in FIG. 9 is that the pivoting motion of the arm 15 and cup 16 is protected and there is little opportunity for an operator to get injured by the movement of the system 10. Another advantage is cleanliness and the reduction in any spillage or splashing of materials being dispensed from the fluid outlet 19.

Therefore, the system 10 provides a simple and efficient mechanism for moving a closure element 16 vertically downward prior to moving the closure element 16 to a circumferentially spaced position away from the fluid path thereby opening up a closed fluid path between one or more nozzles 19 and a container 21 and further provides an easy system for returning the components to the original position either automatically using a spring biasing element 31 with or without reverse operation of the motor 11.

The foregoing description of the exemplary embodiment has been presented for purposes of illustration and description. This disclosure is not intended to be limited to particular embodiment illustrated herein and the alternative embodiments described herein. Other alternatives, modifications and variations will be apparent to those skilled in the art in light of the above disclosure. The disclosed closure system is applicable to almost any fluid dispensing apparatus that dispenses single or multiple fluids. Accordingly, this disclosure is intended to embrace all alternatives, modifications and variations that fall within the spirit and scope of the appended claims.

What is claimed is:

1. A closure system for a fluid outlet, the system comprising:

a motor connected to a threaded shaft that passes through and is enmeshed with a threaded hole of a hub, the threaded hole extending through the hub to a recess disposed within the hub, the hub being connected to a closure for covering the fluid outlet, the hub also comprising an abutment, the hub further comprising a curved slot coaxial with the threaded hole and spaced radially outwardly therefrom, the curved slot terminating at two circumferentially spaced apart ends, the curved slot accommodating a stationary pin that permits a partial rotation of the hub about an axis through the threaded hole, the shaft being connected to a biasing member that engages the stationary pin and the hub and which biases the hub towards a position where the stationary pin engages one of the ends of the curved slot with the closure covering the fluid outlet, the threaded shaft also being connected to a radially outwardly extending finger, the motor rotating the shaft within the threaded hole of the hub resulting in axial movement of the hub and closure away from the motor and fluid outlet respectively and rotating the finger towards the abutment and, when the finger engages the abutment, continued rotation of the shaft overcomes the bias of the biasing member resulting in partial rotation of the hub and closure to a position where the stationary pin engages the other of the ends of the curved slot with the closure being rotated away from the fluid outlet.

2. The closure system of claim 1 wherein the abutment comprises a second pin connected to the hub, and wherein the second pin is disposed within the recess of the hub.

3. The closure system of claim 1 wherein the motor is a two-way motor and reverse action of the motor results in biasing movement of the hub axially along the shaft back to the position where the closure covers the fluid outlet.

4. The closure system of claim 1 wherein the motor is a two way motor and a reverse rotation of the motor and the threaded shaft moves the hub axially back towards the fluid outlet after the bias of the biasing member rotates the hub and closure back into alignment with the fluid outlet.

5. The closure system of claim 1 wherein the biasing member is a spring.

6. The closure system of claim 1 wherein the biasing member is a torsional spring having a body wrapped around the shaft and two radially outwardly extending legs, one leg engaging the stationary pin, the other leg being received in a slot disposed in an inside wall of the hub that defines the recess where the biasing member and finger are also located.

7. The closure system of claim 1 further comprising at least on light emitting device for aligning a container beneath the fluid outlet.

8. The closure system of claim 1 wherein hub is cylindrical with and a flat first end with the curved slot extending from the recess of the hub through the first end, the motor being connected to a mounting plate disposed between first end of the hub and motor, the stationary pin being connected to the mounting plate.

9. The closure system of claim 1 wherein the closure is a polymeric cup for providing a seal around the fluid outlet.

10. The closure system of claim 1 wherein the motor is supported on top of a support plate having holes for accommodating the threaded shaft and fluid outlet, the support plate comprising an underside that is connected to a cover. The cover enclosing the hub and closure element and further comprising a hole for the passage of fluid from the fluid outlet.

11. A closure system for a fluid outlet, the system comprising:

a motor connected to a proximal end of a lead screw also having a distal end with a threaded portion disposed therebetween, the distal end of the lead screw connected a radially outwardly extending finger, the lead screw passing through a threaded hole of a hub having a first end and a second end, the threaded hole extending from the first end that faces the motor to a recess within the hub, the distal end of the lead screw and the finger being disposed within the recess, the hub further comprising an abutment disposed within the recess, the second end of the hub connected to a proximal end of an arm extending radially outwardly from the hub, a distal end the arm being connected to a closure for covering the fluid outlet, the hub comprising a curved slot coaxial with the threaded hole and spaced radially outwardly therefrom, the curved slot terminating at two circumferentially spaced apart ends, the curved slot accommodating a stationary pin that permits a partial rotation of the hub about an axis defined by the threaded hole, the distal end of the lead screw engaging a spring that engages the stationary pin and the hub and which biases the hub towards a position where the stationary pin engages one of the ends of the curved slot with the closure covering the fluid outlet, the motor rotating the lead screw resulting in axial movement of the hub, arm and closure away from the motor and fluid outlet respectively and rotation of the lead screw further rotating the finger within a recess and towards the abutment and, when the finger engages the abutment, continued rotation of the lead screw overcomes the bias of the spring resulting in partial rotation of the hub, arm and closure to a position where the stationary pin engages the other of the ends of the curved slot with the closure being rotated away from the fluid outlet.

12. The closure system of claim 11 wherein the abutment comprises a pin connected to the hub.

13. The closure system of claim 11 wherein the motor is a two way motor with a reverse rotation that moves the hub arm and closure axially towards the fluid outlet after the spring rotates the hub, arm and closure back to a position in alignment with the fluid outlet.

14. The closure system of claim 11 wherein the distal end of the lead screw is connected to a retainer and the spring is disposed between the retainer and the threaded portion of the lead screw.

15. The closure system of claim 11 wherein the spring comprises a body wrapped around the distal end of the lead screw and two radially outwardly extending legs, one leg engaging the stationary pin, the other leg being received in a slot disposed in an inside wall of the hub that defines the recess where the biasing member and finger are located.

16. The closure system of claim 11 wherein an underside of the arm further comprises at least light emitting device for aligning a container beneath the fluid outlet.

17. The closure system of claim 11 wherein hub is cylindrical with and the first end being flat with the curved slot extending from the recess of the hub through the first end, the stationary pin being connected to the motor.

18. The closure system of claim 11 wherein hub is cylindrical with and the first end being flat with the curved slot extending from the recess of the hub through the first end, the motor being connected to a mounting plate disposed between the hub and motor, the stationary pin being connected to the mounting plate.

19. The closure system of claim 11 wherein the closure is a cup that provides a seal around the fluid outlet.

20. The closure system of claim 11 wherein the motor is supported on top of a support plate having holes for accommodating the threaded shaft and fluid outlet, the support plate comprising an underside that is connected to a cover. The cover enclosing the hub and closure element and further comprising a hole for the passage of fluid from the fluid outlet.

* * * * *